United States Patent [19]

Beermann

[11] Patent Number: 5,000,103

[45] Date of Patent: Mar. 19, 1991

[54] SEWING-MATERIAL WORKPIECE HOLDER AND ITS METHOD OF OPERATION

[75] Inventor: Uwe Beermann, Gutersloh, Fed. Rep. of Germany

[73] Assignee: Kochs Adler Aktiengesellschaft, Fed. Rep. of Germany

[21] Appl. No.: 379,609

[22] Filed: Jul. 13, 1989

[30] Foreign Application Priority Data

Jul. 19, 1988 [DE] Fed. Rep. of Germany ..... 3824452

[51] Int. Cl.[5] ..... D05B 21/00

[52] U.S. Cl. ..... 112/121.12; 112/121.15; 112/265.1

[58] Field of Search ..... 112/104, 113, 114, 121.12, 112/121.15, 148, 262.1, 262.3, 265.1, 303, 311, 320

[56] References Cited

U.S. PATENT DOCUMENTS

| | | | |
|---|---|---|---|
| 3,405,670 | 10/1968 | Scholl et al. . | |
| 3,474,747 | 10/1969 | Noiles | 112/121.12 |
| 4,002,129 | 1/1977 | Kraatz | 112/121.15 |
| 4,031,835 | 6/1977 | Gilbride et al. | 112/121.12 X |
| 4,051,794 | 10/1977 | Herzer et al. | 112/121.12 |
| 4,181,085 | 1/1980 | Conner, Jr. | 112/121.12 |
| 4,395,960 | 8/1983 | Jung | 112/265.1 X |
| 4,608,936 | 9/1986 | Ball et al. | 112/121.12 |

*Primary Examiner*—Werner H. Schroeder
*Assistant Examiner*—Paul C. Lewis
*Attorney, Agent, or Firm*—Ostrolenk, Faber, Gerb & Soffen

[57] ABSTRACT

A sewing-material holder for an automatic sewing machine and its method of operation. Two or more sewing-material parts to be sewn, once they have been aligned, can be reliably clamped together and not inadvertently displaced when they are clamped. The upper plate of the sewing-material holder closes over the lower plate by first swinging about an axis of rotation and then lowering vertically. The upper plate of the sewing-material holder is thereby lowered into a position where it contacts a large area of the workpiece which has been placed and aligned on the lower plate, so that uniform clamping takes place instantaneously. The sewing-material holder is advantageously adaptable to being closed automatically, and furthermore is easier to operate even if this is done non-automatically, so that the throughput times are shortened.

19 Claims, 4 Drawing Sheets

SEWING-MATERIAL WORKPIECE HOLDER AND ITS METHOD OF OPERATION

BACKGROUND OF THE INVENTION

1. Field of the Invention

The invention relates to a sewing-material workpiece holder for an automatic sewing machine. It also relates to a method of operation by which the sewing-material workpiece holder closes.

2. Description of Background Art

Sewing-material holders have been known in general for a long time. One example is disclosed in German Patent 3,546,238, the disclosures of which are incorporated by reference, as are the other prior art materials cited herein. In these devices, the workpieces to be sewn to each other are placed in the sewing-material holder, fixed in position by clamping, and then sewn together.

The known sewing-material holders customarily consist of a thin bottom plate and a corresponding upper plate which can be swung shut in the manner of a lid. After closing the sewing-material holder, the pieces of material which are to be sewn to each other are held clamped between the two plates. Both the upper plate and the lower plate have recesses which correspond to the seam to be produced.

A disadvantage of these holders is that the previously carefully aligned individual parts can be relatively displaced when this clamping occurs, in particular when handling larger pieces of material, with correspondingly large-dimensioned sewing-material holders. The reason for this relative displacement is that when the upper plate swings down onto the lower plate, the pieces of material to be sewn are not immediately clamped over a large portion of their area, but rather the area clamped starts from a small, linear contact area at the rear of the sewing-material holder, and is increasingly enlarged until the sewing-material holder is completely closed.

As a result of this shifting of the workpieces, it is not possible to sew them together exactly in accordance with their original alignment. Therefore, these sewing-material holders cannot be used when it is particularly important for the subsequent formation of the seam to take place at a previously precisely defined place, for instance when sewing air bags.

The same problem occurs when a workpiece is to be sewn to a very flexible material, such as foam. Because of the great flexibility of the foam material, the latter is squeezed and pushed together to form a bulge when the workpieces are clamped.

It is possible to conceive of a sewing-material holder in which the upper plate is not swung about any axis or pivot onto the lower plate, but rather is lowered onto it vertically in a straight line. Such a holder would, however, have the disadvantage that the lower plate would no longer be properly visible to the operator, and would no longer be easily accessible because of the guide rods that would be required to guide the upper plate vertically. Because of these problems, with such a hypothetical sewing-material holder, it would be expected to be excessively difficult to place and align the pieces of material to be sewn.

SUMMARY OF THE INVENTION

The principal object of the invention is therefore to provide a method of closing a sewing-material holder which assures that the pieces of material to be sewn, once they have been aligned, are not displaced when they are clamped by the workpiece holder.

This object is achieved by a method of closing a sewing-material holder to clamp at least one sewing material workpiece, the holder comprising at least an upper plate and a lower plate arranged movably with respect to each other, said method comprising the steps of placing and aligning the workpiece on the lower plate; and then clamping the workpiece in its aligned position by closing the upper plate. The upper plate is closed by moving the upper plate toward the lower plate until it is above the lower plate in a plane substantially parallel thereto, and then lowering the upper plate substantially linearly so that it remains substantially parallel with respect to the lower plate, until the workpiece on the lower plate is clamped between the two plates. Preferably the upper plate is swung about an axis of rotation into its position above the lower plate, before being lowered vertically. A plurality of workpieces may be aligned together on said bottom plate. Moreover, more than two plates can be employed.

By the method steps of the invention, it is assured that when the clamping takes place, the upper plate of the sewing-material holder is instantaneously placed with its entire lower surface applied to the lower plate and to the aligned piece or pieces of material to be sewn, so that the latter can no longer change their original position.

A further object is to provide a sewing-material holder by which this method can be realized. The method is carried out by a sewing-material holder comprising at least an upper plate and a lower plate, the upper plate including a frame which is swingable about an axis of rotation into a position above the lower plate, a pressure plate, and means for raising and lowering said pressure plate in a straight line with respect to the frame. Preferably the axis of rotation of the frame lies in a plane which is parallel to said lower plate, and the pressure plate can be raised and lowered while a surface thereof remains substantially parallel to a facing surface of the lower plate. The pressure plate may be suspended below the frame by means of lift cylinders which are actuatable to raise and lower the pressure plate. The lift cylinders may be attached on a side of the frame facing away from the pressure plate, and there may be one or a plurality of alignment or centering pins for guiding the pressure plate as it moves with respect to the frame. The lift cylinders are preferably actuated synchronously by appropriate devices.

Preferably, the frame may be swingably fastened to the work table of the automatic sewing machine by a plurality of hinges, and disposed within a recess in said work table. The hinges may each comprise at least two levers, pivotally connected to each other, one lever being fastened to the frame and the other lever being fastened to the work table. An externally actuatable lift cylinder may be arranged interconnecting the levers so that the frame follows a swinging motion when the piston rod position of the cylinder is changed.

The foregoing features assure that as long as the upper plate is in its swung-away position, the lower plate can be freely inspected and is accessible to the operator.

Also, since the closing and clamping forces are applied to the workpieces by the lift cylinders, it is no longer necessary for the operator to close the sewing-material holder manually, as was previously required. The throughput time is in this way shortened. This is particularly true when two sewing-material holders are employed alongside each other in an automatic sewing machine and the sewing takes place automatically alternating between the two holders. After the operator manually aligns the parts to be sewn in a first holder, the further sewing operations can, preferably, take place automatically, and the operator therefore is able to attend to the second sewing-material holder at the same time.

Other objects, features and advantages of the invention will be understood from the following description of preferred embodiments thereof, with reference to the drawings.

DETAILED DESCRIPTION OF THE PREFERRED EMBODIMENTS

Figure 1:
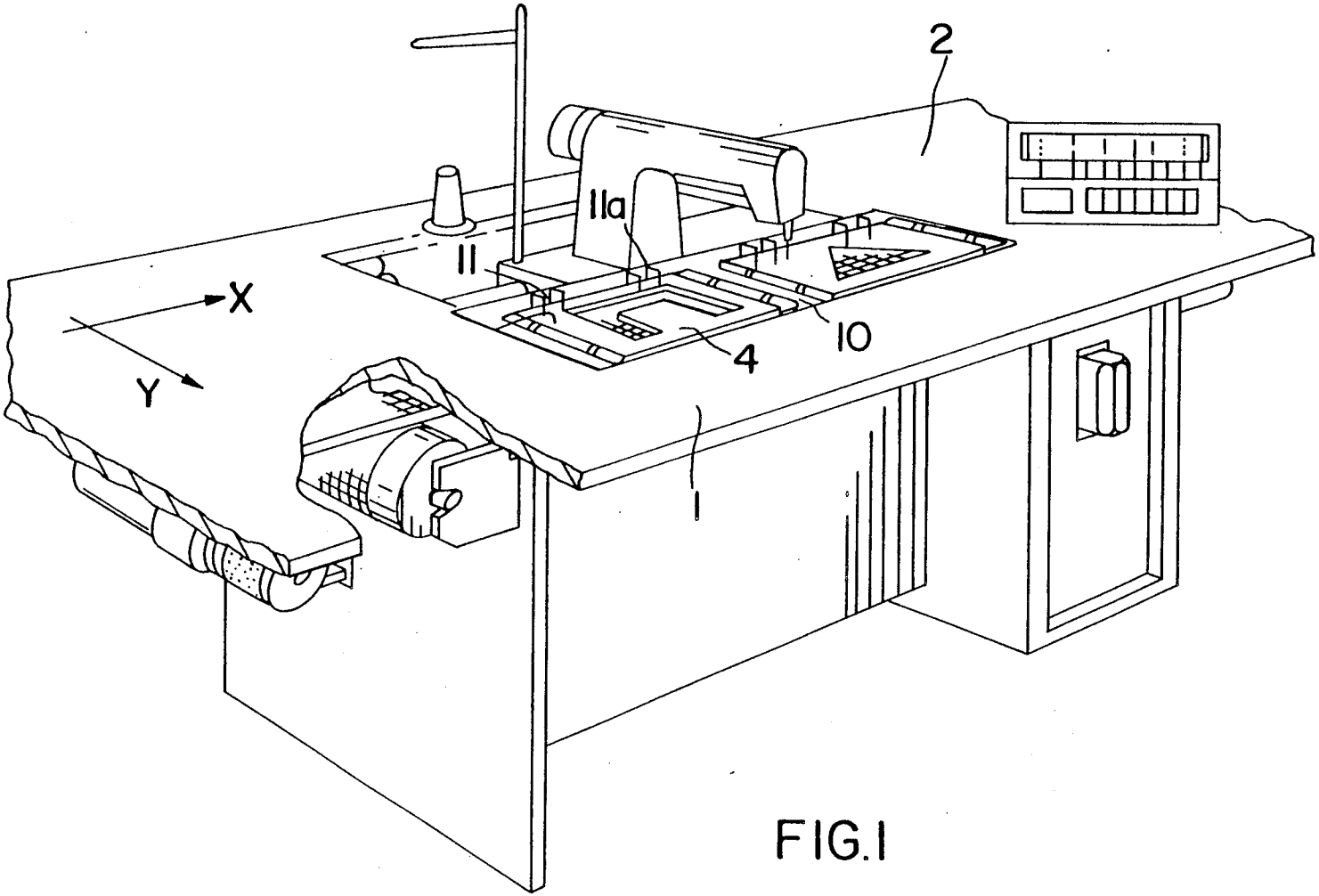
FIG. 1 is a perspective view of an automatic sewing machine and a pair of sewing material holders according to an embodiment of the invention.

FIG. 1 is a perspective view of an automatic sewing machine associated with two sewing-material holders embodying the invention. The construction and operation of such an automatic sewing machine are described in detail in German Patent 3,546,238 and U.S. Pat. No. 4,696,242, for example, so further disclosure is not necessary. These patents are expressly incorporated by reference in the present specification.

In a work table 1 there is provided a recess 10 which provides space for at least one sewing-material holder 2. There are two holders shown in FIG. 1. Each sewing-material holder 2 includes a lower plate 3 and an upper plate 4. The lower plate 3 (FIG. 3) of the sewing-material holder 2 is mounted fixed in position in the recess 10, while the upper plate 4 is fastened by articulations or hinges 11 and 11*a* to the work table 1 and can be rotated about the hinges toward and away from the lower plate 3. The features of the lower plate 3 of the device are known from the abovementioned patents and will therefore not be explained in detail.

Of course, terms herein such as "upper," "lower," "vertical," "horizontal," and the like, are only relative terms and the disclosed apparatus could be oriented differently without departing from the inventive concepts disclosed and claimed herein.

Figure 2:
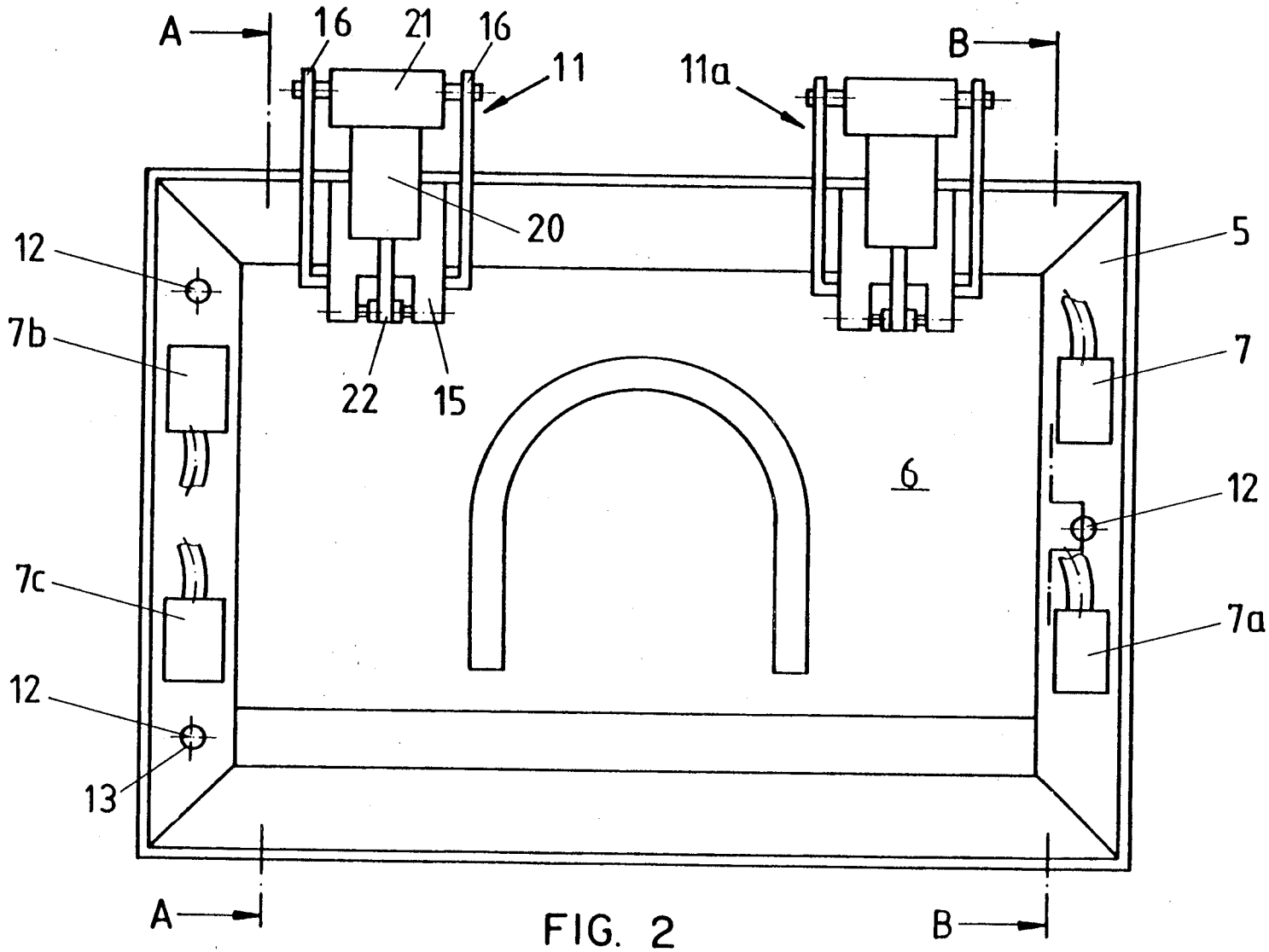
FIG. 2 is a simplified top view of a sewing-material holder.
Figure 3:
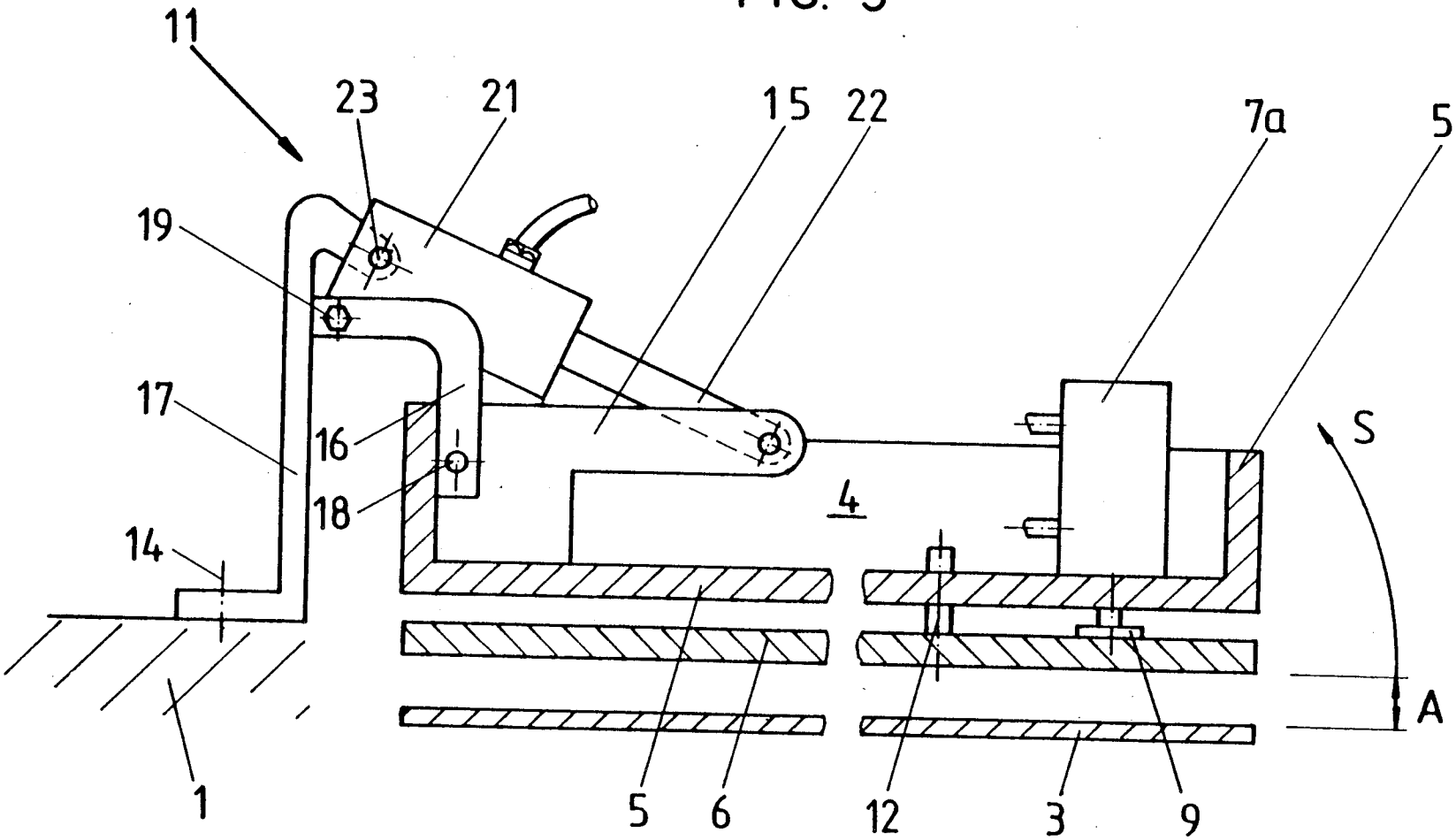
FIG. 3 is a cross-sectional view of the sewing-material holder of FIG. 2 taken along the line A—A.
Figure 4:
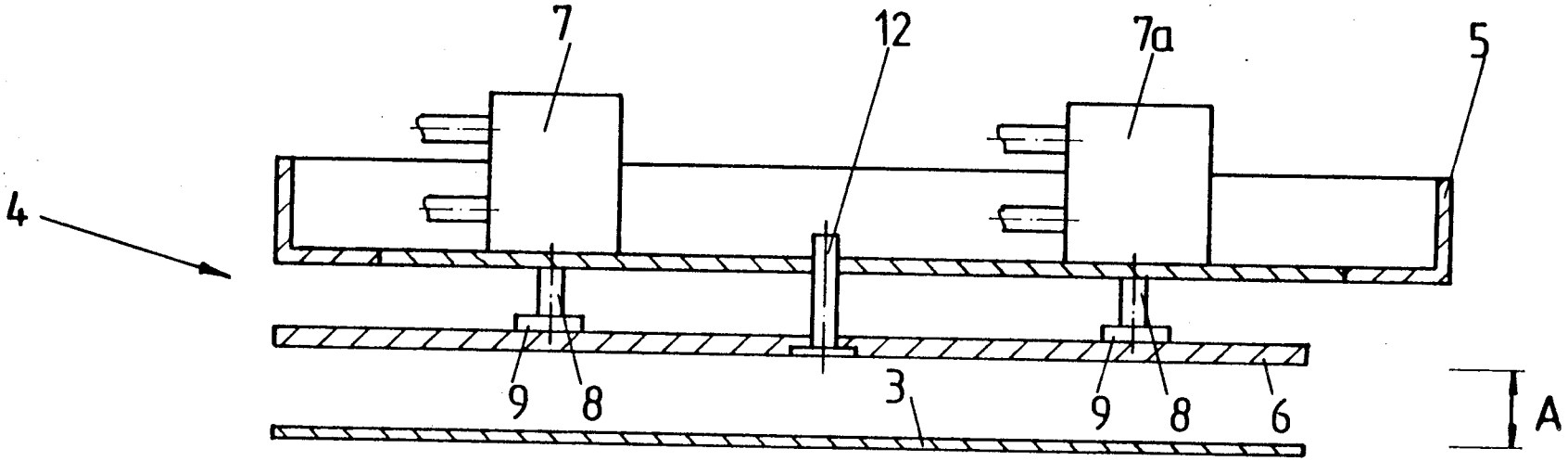
FIG. 4 is a cross-sectional view of the sewing-material holder of FIG. 2, taken along the line B—B.

The upper plate 4 of the sewing-material holder 2 shown in FIGS. 2 and 3 includes a frame 5 and a pressure plate 6. The pressure plate 6 is connected to the frame 5 by four lift cylinders 7, 7*a*, 7*b*, 7*c* which can, for instance, be operated pneumatically. The lift cylinders 7 to 7*c* are fastened to the frame 5 and their piston rods 8 (FIG. 4) are guided in bores provided therein and anchored on the pressure plate 6 via connecting pieces 9. The lift cylinders 7 to 7*c* are preferably double-acting cylinders in which the piston rod 8 is retracted or extended depending on the direction in which the pressure is acting. As shown in FIG. 4 the pressure plate 6 can be raised against the frame 5 or lowered away from it by the lift cylinders 7 to 7*c*.

The pressure plate 6 is arranged below the frame 5, on the side thereof toward the work table 1 of the automatic sewing machine. In order to assure that the pressure plate 6 will be dependably guided when it is raised or lowered, i.e. to permit only a perpendicular direction of movement (relative to the frame), alignment pins 12 are fastened on the pressure plate 6 and engage in corresponding alignment bores 13 in the frame 5.

As best shown in FIG. 3, the hinges 11, 11*a* are arranged on the side of the frame 5 which is opposite the pressure plate 6. The frame 5 is formed of four angle sections in this embodiment. The L-shaped angle sections form the frame 5 in such a manner that its side facing the pressure plate 6 is flat.

The hinges 11, 11*a* are formed in this embodiment by three levers 15, 16, 17. The lever 15 is firmly attached to the frame 5. The lever 16 is connected to the lever 15 via an articulation 18 and is screwed to the lever 17 at a point 19. The lever 17 is fixed to the work table 1 by means of screws 14.

The hinges 11, 11*a* are controlled via externally actuatable cylinders 20. These cylinders 20 are preferably pneumatic lift cylinders. Each cylinder 20 is connected to the levers 15 and 17 by an articulation. In this embodiment, the housing 21 of the cylinder 20 is connected to the lever 17, by means of an eye 23, and its piston rod 22 is connected to the lever 15.

As best seen in FIG. 2, in one preferred embodiment of the hinges 11, the levers 15, 16, 17 are each provided in symmetrical pairs and the articulated cylinders 20 are disposed between them. That is, the lever arrangement shown in side view in FIG. 3 is repeated in mirror-image on the other side of the cylinder 20.

In the position shown in FIG. 3, the piston rod 22 of the cylinder 20 is completely extended and the upper plate 4 is therefore shown in its lowered position, above and parallel to the lower plate 3. As will be understood from this figure, when the piston rod 22 of the pneumatic cylinder 20 is retracted, the upper plate 4 executes a swinging movement upward in the direction of the arrow S about the pivot point 18, so that the upper plate 4 is swung away from the lower plate 3. When the upper plate 4 is in this position, the cylinders 7*a* to 7*c* are retracted so that the pressure plate 6 is located as closely as possible to the frame 5. Preferably, the hinges 11, 11*a* are formed so that a swinging movement of at least 45° is possible. Thus, when the upper plate 4 is in its completely swung-away position, the operator can see the lower plate 3 of the sewing-material holder unimpeded and can align thereon the parts to be sewn.

After the alignment of the workpieces on the lower plate 3, each cylinder 20 is actuated so that its piston rod 22 is extended and the upper plate 4 is swung in the direction of the lower plate 3 until the pressure plate 6 is in a plane substantially parallel to the lower plate 3. The lift cylinders 7 to 7*c* are then actuated so that their piston rods 8 are extended. The pressure plate 6 is thereby lowered perpendicularly (arrow A) relative to the frame 5—and more importantly, relative to the lower plate 3—until the parts to be sewn are clamped between the plates 6, 3.

As described in German Patent 3,546,238, the automatic sewing machine is computer-controlled. An individual skilled in the art will also readily know how to arrange for computer control of the closing of the sewing-material holder, so that a completely automated process can take place after the initial alignment of the material to be sewn.

Since the pressure plate 6 is applied against the lower plate 3 in a linear movement, the parts to be sewn are immediately clamped over a large surface area thereof, which reliably prevents any undesired displacement during the clamping step. It will also be known to an individual skilled in the art how to control the pneumatic cylinders 7, *7a*, *7b*, *7c* simultaneously in order to make it possible to linearly lower the pressure plate 6 parallel to the lower plate 3. For example, in one technique for this purpose, the control lines to the pneumatic cylinders 7 to *7c* all have the same length, in order to assure simultaneous response.

Figure 5:
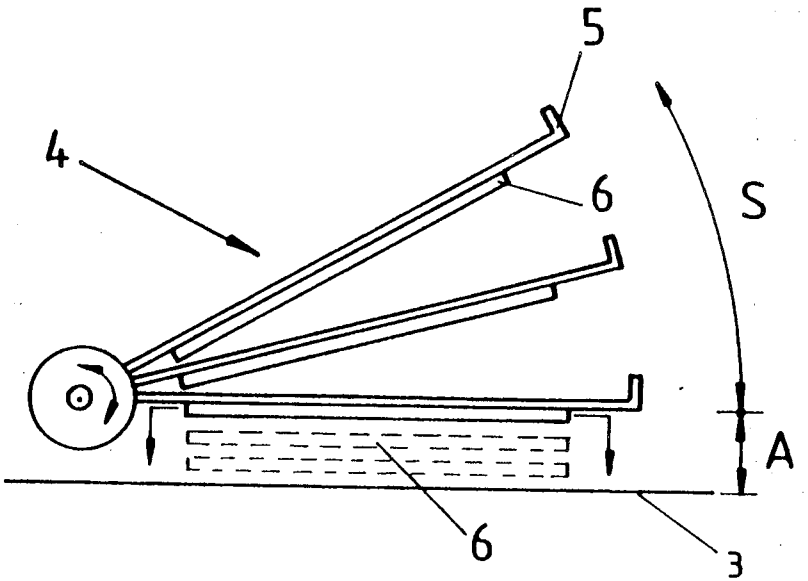
FIG. 5 is a sketch showing the course of the movements that take place when the sewing-material holder is closed.

FIG. 5 shows the course of movement which results when the upper plate 4 swings arcuately and then descends linearly during the above-described closing of the sewing-material holder 2. It can be seen that the frame 5 of the upper plate 4 follows a pure swinging motion (arrow S) in the first phase, with the pressure plate 6 in its raised position as close as possible to the frame 5. The frame 5 is stationary in the second phase, which ultimately leads to the clamping of the parts to be sewn, wherein the pressure plate 6 is lowered relative to the frame 5 in a straight-line path (arrow A) perpendicular to the lower plate 3.

Such a sewing-material holder can, in general, also be employed and adapted in such a manner that several stacked parts to be sewn can be positioned and clamped with respect to each other as one unit. In such a case the sewing-material holder may have additional plates arranged on the hinges 11, 11*a* between the lower and upper plates 3 and 4.

Although illustrative embodiments of the invention have been disclosed herein, the claims are not to be construed as limited to such embodiments, but rather to cover all modifications and variations that may occur to one having ordinary skill in the art, and fairly encompassed within the inventive teachings set forth herein.

What is claimed is:

1. A method of closing a sewing-material holder to clamp at least one sewing material workpiece, comprising the steps of:

providing a holder including at least an upper plate and a lower plate arranged movably with respect to each other;

placing and aligning said at least one workpiece on said lower plate; and then clamping the at least one workpiece in an aligned position by swinging the upper plate about an axis of rotation until it is above the lower plate and a surface of said upper plate is in a plane substantially parallel to a facing surface of said lower plate, and then lowering the upper plate substantially linearly so that said surface remains substantially parallel with respect to the lower plate, until the workpiece on the lower plate is clamped between the upper and lower plates.

2. A method as in claim 1, wherein a plurality of said workpieces are aligned together on said bottom plate.

3. A method as in claim 2, wherein a plurality of additional plates are provided between said upper and lower plates, and said workpieces are clamped between respective pairs of said plates.

4. A method of closing a sewing-material holder to clamp at least one sewing material workpiece, comprising the steps of:

providing a holder including at least an upper plate and a lower plate arranged movably with respect to each other;

placing and aligning said at least one workpiece on said lower plate; and then clamping the at least one workpiece in an aligned position by moving the upper plate toward the lower plate until it is above the lower plate with a surface of said upper plate in a plane substantially parallel to a facing surface of said lower plate, and then lowering the upper plate substantially linearly so that it remains substantially parallel with respect to the lower plate, until the workpiece on the lower plate is clamped between the upper and lower plates;

wherein said upper plate is swung about an axis of rotation as it is moved into a position above the lower plate;

providing at least one lifting device interconnecting a sewing machine work table and said upper plate; and actuating said lifting device to swing said upper plate about its axis of rotation.

5. A method as in claim 4, wherein said lifting device is actuated pneumatically.

6. A method of closing a sewing-material holder to clamp at least one sewing material workpiece, comprising the steps of:

providing a holder including at least an upper plate and a lower plate arranged movably with respect to each other;

placing and aligning said at least one workpiece on said lower plate; and then clamping the at least one workpiece in an aligned position by moving the upper plate toward the lower plate until it is above the lower plate with a surface of said upper plate in a plane substantially parallel to a facing surface of said lower plate, and then lowering the upper plate substantially linearly so that it remains substantially parallel with respect to the lower plate, until the at least one workpiece on the lower plate is clamped between the upper and lower plates;

providing said upper plate in a form of a frame, and a pressure plate attached to the frame and having a lower surface substantially parallel to an upward surface of the lower plate; and lowering the upper plate toward the lower plate by moving the pressure plate away from the frame and toward the lower plate.

7. A method as in claim 6, further comprising the steps of:

providing a plurality of lifting devices interconnecting said frame and pressure plate; and actuating said plurality of lifting devices substantially simultaneously in order to move the pressure plate away from the frame.

8. A method as in claim 7, wherein said lifting devices are actuated pneumatically.

9. A sewing-material holder comprising:

at least an upper plate and a lower plate, the upper plate including a frame having means permitting the upper plate to be swung about an axis of rotation into a substantially parallel position above the lower plate; a pressure plate; and means for then raising and lowering said pressure plate in a straight line so that a lower surface of said pressure plate remains substantially parallel with respect to a facing surface of said lower plate.

10. A sewing-material holder as in claim 9, wherein said axis of rotation is in a plane parallel to said facing surface of said lower plate.

11. A sewing-material holder as in claim 10, wherein the pressure plate is suspended below the frame by a plurality of lift devices actuatable to raise and lower the pressure plate.

12. A sewing-material holder as in claim 11, wherein said lift devices are pneumatic cylinders.

13. A sewing-material holder as in claim 11, further comprising means for actuating the lift devices synchronously.

14. A sewing-material holder comprising:

at least an upper plate and a lower plate, the upper plate including a frame having means permitting it to be swung about an axis of rotating into a position above the lower plate; a pressure plate; and means for raising and lowering said pressure plate in a straight line so that a lower surface of said upper plate remains substantially parallel with respect to a facing surface of said lower plate;

wherein said axis of rotation is in a plane parallel to said facing surface of said lower plate;

wherein the pressure plate is suspended below the frame by a plurality of lift devices actuatable to raise and lower the pressure plate; and wherein the lift devices are attached on a side of the frame facing away from the pressure plate, and further comprising a plurality of alignment pins for guiding the pressure plate as it moves with respect to the frame.

15. A sewing-material holder comprising:

at least an upper plate and a lower plate, the upper plate including a frame having means permitting it to be moved into a position above the lower plate; a pressure plate; and means for raising and lowering said pressure plate in a straight line so that a lower surface of said upper plate remains substantially parallel with respect to a facing surface of said lower plate; and wherein the frame is swingably fastened to a work table of an automatic sewing machine by a plurality of hinges.

16. A sewing-material holder as in claim 15, wherein the sewing-material holder is disposed within a recess in said work table.

17. A sewing-material holder as in claim 15, wherein the hinges each comprise two levers, pivotally connected to each other, one lever being fastened to the frame and the other lever being fastened to the work table.

18. A sewing-material holder as in claim 17, wherein at least one externally actuatable lift device is arranged interconnecting the levers so that said frame follows a swinging motion when said lift device is actuated.

19. A sewing-material holder as in claim 18, wherein said lift device is a pneumatic cylinder having a housing attached to one of said levers and a piston rod attached to the other of said levers.

* * * * *